United States Patent [19]

Smith

[11] 4,391,659

[45] Jul. 5, 1983

[54] EXPLOSIVE

[75] Inventor: Jeremy G. B. Smith, Edenvale, South Africa

[73] Assignee: AECI Limited, Johannesburg, South Africa

[21] Appl. No.: 378,719

[22] Filed: May 17, 1982

[30] Foreign Application Priority Data

May 26, 1981 [ZA] South Africa ..... 81/3531

[51] Int. Cl.[3] ..... C06B 45/00

[52] U.S. Cl. ..... 149/2; 149/21; 149/46; 149/60; 149/61; 149/76; 149/83; 149/85

[58] Field of Search ..... 149/2, 21, 46, 60, 61, 149/76, 83, 85

[56] References Cited

U.S. PATENT DOCUMENTS

| | | | |
|---|---|---|---|
| 3,765,964 | 10/1973 | Wade | 149/2 |
| 4,110,134 | 8/1978 | Wade | 149/2 |
| 4,111,727 | 9/1978 | Clay | 149/2 |
| 4,141,767 | 2/1979 | Sudweeks et al. | 149/2 |
| 4,218,272 | 8/1980 | Brockington | 149/2 |
| 4,231,821 | 11/1980 | Sudweeks et al. | 149/2 |
| 4,310,364 | 1/1982 | Ekman et al. | 149/2 |
| 4,315,784 | 2/1982 | Hattori et al. | 149/2 |
| 4,315,787 | 2/1982 | Hattori et al. | 149/2 |
| 4,322,258 | 3/1982 | Sudweeks et al. | 149/2 |
| 4,326,900 | 4/1982 | Hattori et al. | 149/2 |

*Primary Examiner*—Stephen J. Lechert, Jr.

*Attorney, Agent, or Firm*—Cushman, Darby & Cushman

[57] ABSTRACT

The invention concerns an emulsion explosive of the water-in-fuel type which has as its discontinuous phase an oxidizing salt-containing component, and as its continuous phase a fuel component which is immiscible with the discontinuous phase, the continuous phase comprising at least a proportion of polymer in liquid form or in finely divided particle form. A method of making the explosive is also described.

19 Claims, No Drawings

EXPLOSIVE

This invention relates to an explosive. In particular the invention relates to an explosive of the emulsion type in which an oxidizing salt-containing component forms the discontinuous phase in an emulsion wherein the continuous phase comprises a fuel component which is immiscible with the discontinuous phase.

Such explosives, where the oxidizing salt-containing component contains water and is in the form of an aqueous solution are known as 'water-in-fuel' emulsions, and when the oxidizing salt component includes little or no water they can be regarded as 'melt-in-fuel' emulsions. In certain circumstances, these explosives suffer from the disadvantage that they are unstable in that crystallisation and/or coalescence of the discontinuous phase occurs.

According to the invention, an emulsion explosive of the water-in-fuel type has as its discontinuous phase an oxidizing salt-containing component, and as its continuous phase a fuel component which is immiscible with the discontinuous phase, the continuous phase comprising at least a proportion of polymer in liquid form or finely divided particle form.

The polymer may be capable of forming a suspension or emulsion in water, being for example of the type which is capable of dispersion in water by emulsion or suspension polymerization techniques, and polymers capable of dispersion in water by dispersion polymerization techniques have also been found to be suitable. For certain polymers, depending on molecule size, the dispersion can be regarded as a solution, and dispersion in this context is intended to include also polymer solutions.

The continuous phase may comprise, in addition to the polymer, a fuel which is insoluble in and immiscible with water. The fuel may be a non-self-explosive organic liquid fuel, and may be selected from the group consisting in hydrocarbons, halogenated hydrocarbons, nitrated hydrocarbons or mixtures thereof. Thus, the fuel may be selected from minerals, fuel oils, lubricating oils, liquid paraffin, microcrystalline waxes, paraffin waxes, xylene, toluene, dinitrotoluene, and mixtures thereof. Instead, however, the continuous phase may comprise the polymer by itself, acting as the fuel, without an additional fuel.

The polymer may comprise an acrylonitrile/butyl acrylate copolymer, a vinyl acetate/ethylene copolymer, or a mixture thereof.

The discontinuous phase may comprise an oxidizing salt selected from the group consisting in ammonium, alkali metal or alkaline earth metal nitrates, or perchlorates, or mixtures thereof. Thus, the discontinuous phase may comprise ammonium nitrate and at least one compound which is immiscible with the continuous phase and which can act as an oxygen-releasing salt and/or fuel, and which together with the ammonium nitrate, forms a melt having a lower melting point than that of ammonium nitrate.

The explosive may contain an effective amount of a suitable emulsifier for stabilizing the emulsion and for combating coalescence of the discontinuous phase. The emulsifier will typically form part of the continuous phase, and can act as a fuel. The emulsifier may be selected from the group consisting in sorbitan sesquioleate, sorbitan monooleate, sorbitan tristearate, the mono- and diglycerides of fat-forming fatty acids, soya bean lecithin, derivatives of lanolin, alkyl benzene sulphonates, oleyl acid phosphate, laurylamine acetate, decaglycerol decoaleate, decaglycerol decastearate, 2-oleyl-4,4'-bis(hydroxymethyl)-2-oxazoline and suitable mixtures of the aforegoing.

The emulsifiers act as surfactants and stabilizers to promote the formation of the emulsion and to resist coalescence of the discontinuous phase.

In general, the water in the discontinuous phase should be kept at a minimum consistent with forming a satisfactory emulsion, to prevent wasted energy arising from steam production upon detonation.

The continuous phase may form up to about 25% by mass of the emulsion. The continuous phase usually is present in amounts of 2–25% of the emulsion by mass, or preferably being in the region of about 3–12% by mass thereof.

Further according to the invention, a method of making an emulsion explosive of the water-in-fuel type comprises emulsifying an aqueous solution or melt containing an oxidizing salt, and an aqueous dispersion of a polymer to form an emulsion in which the oxidizing salt forms part of the discontinuous phase and the polymer forms at least part of the continuous phase, the continuous phase forming a fuel component in the explosive and being immiscible with the discontinuous phase which forms an oxidizing salt-containing component.

The invention extends to a method of stabilizing an emulsion explosive of the water-in-fuel or melt-in-fuel type which has as its discontinuous phase an oxidizing salt-containing component and as its continuous phase a fuel component immiscible with the discontinuous phase, the method comprising adding to the emulsion, or replacing at least part of the fuel component in the emulsion with, an aqueous dispersion of a polymer.

The method of the invention may be used to produce explosives of the type described above, and the aqueous dispersion of the polymer used in the method may be in the form of an aqueous suspension or emulsion. As mentioned above, such dispersions, when prepared by emulsion, suspension or dispersion polymerization techniques, have been found to be suitable for the invention.

The proportion of the polymer in the dispersion used is conveniently at least 20% by mass of the dispersion. The maximum proportion of polymer of the dispersion is to a certain extent determined by the proportion of water needed to stabilize such a dispersion. The proportion of water in the dispersion is, however, desirably kept low to prevent wasted energy, as mentioned above, arising from steam production upon detonation of the final explosive product.

In accordance with the method, a suitable emulsifier may be used to facilitate formation of the emulsion, and the emulsifier may be selected from the emulsifiers described hereinabove.

When the fuel component contains a fuel in addition to the polymer and any emulsifier used, then during the making or stabilizing of the explosive in accordance with the method of the present invention, the oxidizing salt-containing component should be emulsified with the polymer dispersion in the presence of the additional fuel. In other words, the polymer dispersion may be added to the fuel before, during, or after addition of the oxidizing salt-containing component to the fuel, but the polymer dispersion should not be added to the oxidizing salt-containing component before the oxidizing salt-containing component is added to the fuel. Upon emulsification, the water in the polymer dispersion combines with the droplets of the aqueous solution or melt containing the oxidizing salt used for the discontinuous phase, to become part of the discontinuous phase, the polymer remaining in the continuous phase.

The invention will now be described, by way of illustration, with reference to the following non-limiting Examples:

EXAMPLE 1

An aqueous solution was prepared by heating to 100° C. a mixture of 68,3 parts by mass ammonium nitrate, 13,6 parts by mass sodium nitrate and 11,5 parts by mass water.

This solution at 90° C. was added to a mixture of 2,6 parts by mass SPAN 80 (an emulsifier comprising sorbitan monooleate available from Atlas Oil & Chemical Company (Proprietary) Limited and 1 part by mass REVERTEX 272 (an aqueous suspension of 45% by mass butyl acrylate/acrylonitrile particles in the size range 0,1–0,2 microns in 55% by mass water available from Revertex (South Africa) (Proprietary) Limited; and an emulsion was formed by means of a HOBART mixer with a wire whip operated for 2 minutes at 285 rpm and for 10 minutes at 591 rpm.

Thereafter 3% by mass C15-50 microballoons (available from 3M (South Africa) (Proprietary) Limited) were added to the emulsion.

An emulsion explosive was obtained which, when compared with a control in which the REVERTEX 272 was replaced by an equal mass of P95 oil (paraffinic hydrocarbon (fuel) available from B P Southern Africa (Proprietary) Limited), showed comparable sensitivity, comparable stability to coalescence at 40° C. and substantially enhanced stability to coalescence at −17° C.

EXAMPLE 2

Example 1 was repeated except that the SPAN 80/P95 oil/REVERTEX 272 mixture was 2,6/2/2 parts by weight. An explosive with similar properties was obtained with enhanced stability to coalescence at −17° C. compared with a control where the REVERTEX was replaced by the same mass of P95 oil.

EXAMPLE 3

Example 2 was repeated with a SPAN 80/P95 oil/-REVERTEX 272 mix of 2,6/1/3 parts by weight and again similar results were obtained with enhanced stability at −17° C., compared with a control where the REVERTEX was replaced by the same mass of P95 oil.

EXAMPLE 4

The procedure of Example 1 was further repeated with variations also in the ammonium nitrate/sodium nitrate/water mix. The compositions of the explosives are set out in the following Table:

TABLE 1

| No. | Ammonium nitrate/ sodium nitrate/ water PARTS BY MASS | SPAN 80/P95 oil/ REVERTEX 272 PARTS BY MASS |
|---|---|---|
| 1. | 68,3/13,6/10,5 | 2,6/3,0/2,0 |
| 2. | 68,3/13,6/11,0 | 2,6/3,5/1,0 |
| 3. | 68,3/13,6/10,0 | 2,6/2,5/3,0 |

Once again emulsion explosives were obtained with enhanced stability at −17° C. but which were otherwise comparable with controls in which the REVERTEX was replaced by the same mass of P95 oil.

EXAMPLE 5

The procedure of Example 1 was repeated using the same mass of AIRFLEX 120 (an aqueous suspension of 50% by mass of a copolymer of vinyl acetate and ethylene in 50% by mass of water available from Air Products (South Africa) (Proprietary) Limited) instead of the REVERTEX 272. An explosive was obtained with substantially similar properties to that of Example 1 with enhanced stability at −17° C. compared with the control of Example 1.

EXAMPLE 6

Example 3 was repeated except that the wire whip of the mixer was operated for 12 minutes at 139 rpm. This emulsion explosive was found to be cap sensitive to initiation at 5° C. in contrast to the control referred to in Example 3 which when mixed at 139 rpm for 12 minutes was not cap sensitive. Cap sensitivity was retained with the polymer present with the whip operated for 2 minutes at 139 rpm followed by 10 minutes at 285 rpm; and for 12 minutes at 139 rpm. These tests demonstrate that with the polymer present cap sensitive emulsions can be formed at lower shear than with the controls.

EXAMPLE 7

A 40 kg batch of explosive in accordance with the present invention was manufactured under low shear conditions, using a conventional concrete mixer (15–30 rpm). The following formulation was employed:

| Constituent | Mass % |
|---|---|
| Ammonium nitrate | 56,69 |
| Sodium nitrate | 19,29 |
| Water | 15,00 |
| P95 oil | 4,12 |
| ARLACEL 83 (sorbitan sesquioleate available from Atlas Chemical Company) | 0,60 |
| Soya lecithin | 0,60 |
| B246 (emulsifier available from Imperial Chemical Industries PLC - Paints Division) | 0,20 |
| REVERTEX 272 | 1,00 |
| C15/250 microballoons (available from 3M (South Africa) (Proprietary) Limited) | 2,50 |

The resultant emulsion explosive was found to be sensitive to a 30 g booster for a period in excess of three months when stored in 65 mm diameter plastics sleeves. This formulation is believed to have special significance in the bulk emulsion field where stabilities in excess of two weeks are regarded as adequate, the explosive of this example providing a satisfactory safety margin.

EXAMPLE 8

In a series of tests, a number of different aqueous polymer dispersions were screened for enhancing the stability of emulsion explosives of the type described herein, and were compared with a control prior art emulsion explosive of the water-in-oil type having the following formulation:

| Constituent | Mass % |
|---|---|
| Ammonium Nitrate | 68,3 |

-continued

| Constituent | Mass % |
|---|---|
| Sodium Nitrate | 13,6 |
| Water | 11,5 |
| Span 90 (emulsifier) | 2,6 |
| P95 Oil | 4,0 |

The control has characteristics well known to the Applicant, and it has a very limited shelf life and stability at temperatures of 40° C., ambient, and at −17° C. Any enhancement to its stability would be evident in a short time.

In the tests in each case, the dispersion was added to the oil before emulsification, 1, 2, 3 and 4% by mass of the dispersion replacing the equivalent mass of the oil, emulsification being effected in a conventional manner, as used to emulsify the control. Initial storage stabilities were determined in glass jars at 40° C., ambient, and −17° C. in the absence of glass microballoons. The more promising formulations were mixed with 2,5% by mass C15/250 microballoons and stored in 25 mm waxed paper shells, and their sensitivities monitored at regular intervals at 5° C. Initial sensitivities of the emulsions were determined as a function of increasing dispersion addition. The dispersions screened are set out in the following Table:

TABLE 2

| Dispersion | Nature of Polymer | Solids Content mass % | Glass transition temp. (°C.) |
|---|---|---|---|
| 1 | Hard x-linking acrylic | — | — |
| 2 | Soft x-linking acrylic | — | — |
| 3 | Extremely soft acrylic | — | — |
| 4 | Soft acrylic | 52 | — |
| 5 | Intermediate acrylic | 52 | — |
| 6 | Hard acrylic | 50 | — |
| 7 | Hard polyvinylalcohol | 56 | — |
| 8 | Hard polyvinylalcohol (different stabiliser) | 56 | — |
| 9 | Styrene/acrylic - medium | 51 | — |
| 10 | Styrene/acrylic - hard | 40 | — |
| 11 | Acrylic alkali soluble | 22 | — |
| 12 | Acrylic alkali soluble (low molecular weight) | 45 | — |
| 13 | Styrene/butadiene (high butadiene) | 65 | — |
| 14 | Styrene/butadiene (high styrene) | 52 | — |
| 15 | Soft x-linking acrylic | 45 | — |
| 16 | Ethylene/vinyl chloride | 50 | 30 |
| 17 | Vinylacetate/ethylene | 55 | 18 |
| 18 | Vinylacetate/ethylene | 55 | 7 ± 3 |
| 19 | Vinylacetate/ethylene | 55 | 0 ± 2 |
| 20 | Vinylacetate/ethylene | 52 | 0 |
| 21 | Vinylacetate/ethylene | 52 | 0 |
| 22 | Vinylacetate/ethylene | 52 | −15 |
| 23 | Vinylacetate/ethylene | 52 | −20 |
| 24 | Polyvinyl acetates | 55 | −28 |
| 25 | Styrene/acrylate (x-linkable) | 45 | −7 |
| 26 | Styrene/acrylate (x-linkable) | 45 | −13,5 |
| 27 | Styrene/acrylate (x-linkable) | 45 | 6 |
| 28 | Styrene/acrylate (solution) | 60 | 39 |
| 29 | Styrene/acrylate (solution) | 60 | −4 |

Dispersions 1–15 were obtained from Revertex (South Africa) (Proprietary) Limited; 16–24 from Air Products (South Africa) (Proprietary) Limited; and 25–29 from Bevaloid (South Africa) (Proprietary) Limited. Polymer content in the dispersion and glass transition temperature of the polymers are shown in Table 2, where known.

It was observed in general that, while stabilities at 40° C. were not significantly enhanced, the emulsion stabilities at −17° C. were enhanced. Sensitivity of the explosive was found to decrease with increasing dispersion content.

Sample 15 (Revertex 272) was found to provide greatly enhanced stability at −17° C., and an emulsion containing 1% of Revertex 272 by mass when cartridged and stored at −17° C. was found to be cap-sensitive for three months. Emulsions containing Revertex 272 stored at ambient temperatures were cap-sensitive after 40 to 50 days, compared with 25–30 days for the control, but emulsions containing 1,2 and 3% by mass Revertex 272 did not show enhanced stability compared with the control at 40° C., but stabilities of the same order.

Emulsions containing Sample 17 (AIRFLEX 120) displayed increased stabilities at 40° C., ambient and −17° C., when stored in glass jars. Initial sensitivities, even at the 3% by mass level of incorporation, were found to be good. However, storage with microballoons in 25 mm waxpaper cartridges at ambient temperatures, led to the emulsions' becoming cap-insensitive after one week.

Apart from Samples 15 and 17, no appreciable stability enhancement was encountered when stored with glass microballoons in 25 mm waxpaper cartridges, but only when stored in glass jars.

From the various tests conducted, variation in the solids content and particle size in the dispersion, did not appear to cause variations in the observed effects, except to the extent that use of the dispersions having a low solids content will require a proportionately increased proportion of dispersion in addition to the explosive, resulting in decreased sensitivity. Without being bound by theory, the Applicant however believes that glass transition temperatures may be important for low temperature stability, and in general those polymers with the lowest glass transition temperatures exhibited the greatest low temperature stability. Revertex 272 is believed to have a glass transition temperature of about −30° C.

Without being bound by theory the applicant believes that the presence of the polymer particles in the continuous phase may physically retard movement of discontinuous phase droplets towards each other, this mechanism acting to retard coalescence and enhance stability.

The Applicant believes that the enhanced stability for ammonium nitrate containing explosives according to the invention may be present to a greater or lesser degree at all temperatures encountered in practice; and the applicant contemplates that the invention will have particular utility in arctic or sub-arctic conditions at temperatures of the order of −10° C. or less where useful storage life out of doors can be extended up to at least 65 days. In all cases when the HOBART mixer was used at the high speed described above, emulsions according to the invention containing the polymer dispersion were found to have enhanced stability at −17° C. Emulsions formed at the low speed described above were found to have enhanced stability at 40° C., compared with control emulsions.

While only Samples 15 and 17 in Example 8 were found to have enhanced storage lives when cartridged with microballoons, all the samples tested were found to have enhanced low temperature storagability when stored under glass. Thus, they can be prepared in bulk, and stored in bulk, at low temperatures in the absence of glass microballoons for bulk usage of explosives, and can be mixed with microballoons on site immediately before use.

I claim:

1. An emulsion explosive of the water-in-fuel type which has as its discontinuous phase an oxidizing salt-containing component, and as its continuous phase a fuel component which is immiscible with the discontinuous phase, the continuous phase comrising at least a proportion of a polymeric dispersion.

2. An explosive as claimed in claim 1, in which the polymer is capable of forming a suspension or emulsion in water.

3. An explosive as claimed in claim 1, in which the continuous phase comprises, in addition to the polymer, a fuel which is insoluble in and immiscible with water.

4. An explosive as claimed in claim 3, in which the fuel is a non-self-explosive organic liquid fuel.

5. An explosive as claimed in claim 4, in which the fuel is selected from the group consisting in hydrocarbons, halogenated hydrocarbons, nitrated hydrocarbons or mixtures thereof.

6. An explosive as claimed in claim 1, in which the polymer comprises an acrylonitrile/butyl acrylate copolymer, a vinyl acetate/ethylene copolymer or a mixture thereof.

7. An explosive as claimed in claim 1, in which the discontinuous phase comprises an oxidizing salt selected from the group consisting in ammonium, alkali metal or alkaline earth metal nitrates, or perchlorates, or mixtures thereof.

8. An explosive as claimed in claim 7, in which the discontinuous phase comprises ammonium nitrate and at least one compound which is immiscible with the continuous phase and which can act as an oxygen-releasing salt and/or fuel, and which together with ammonium nitrate forms a melt having a lower melting point than that of ammonium nitrate.

9. An explosive as claimed in claim 1, which contains a suitable emulsifier for stabilizing the emulsion and for combating coalescence of the discontinuous phase.

10. An explosive as claimed in claim 9, in which the emulsifier is selected from the group consisting in sorbitan sesquioleate, sorbitan monooleate, sorbitan tristearate, the mono- and diglycerides of fat-forming fatty acids, soya bean lecithin, derivatives of lanolin, alkylbenzene sulphonates, oleyl acid phosphate, laurylamine acetate, decaglycerol decaoleate, decaglycerol decastearate, 2-oleyl-4,4'-bis(hydroxymethyl)-2-oxazoline and suitable mixtures of the aforegoing.

11. An explosive as claimed in claim 1, in which the continuous phase forms from 2–25% by mass thereof.

12. An explosive as claimed in claim 11, in which the continous phase forms from 3–12% by mass thereof.

13. A method of making an emulsion explosive of the water-in-fuel type which comprises emulsifying an aqueous solution or melt containing an oxidizing salt, and an aqueous dispersion of a polymer to form an emulsion in which the oxidizing salt forms part of the discontinuous phase and the polymer forms at least part of the cntinuous phase, the continuous phase forming a fuel component in the explosive and being immiscible with the discontinuous phase which forms an oxidizing salt-containing component.

14. A method as claimed in claim 13, in which the explosive is as claimed in claim 1.

15. A method as claimed in claim 13, in which the aqueous dispersion of the polymer is in the form of an aqueous suspension or emulsion.

16. A method as claimed in claim 13, in which the aqueous dispersion comprises at least 20% by mass of the polymer.

17. A method as claimed in claim 13, in which the fuel component contains a fuel in addition to the polymer and in which, during the making or stabilizing of the explosive, the oxidizing salt-containing component is emulsified with the polymer dispersion in the presence of the additional fuel.

18. A method as claimed in claim 13, in which a suitable emulsifier is used to facilitate formation of the emulsion, and is selected from the group consisting in sorbitan sesquioleate, sorbitan monooleate, sorbitan tristearate, the mono- and diglycerides of fat-forming fatty acids, soya bean lecithin, derivatives of lanolin, alkylbenzene sulphonates, oleyl acid phosphate, laurylamine acetate, decaglycerol decaoleate, decaglycerol decastearate, 2-oleyl-4,4'-bis(hydroxymethyl)-2-oxazoline and suitable mixtures of the aforegoing.

19. A method of stabilizing an emulsion explosive of the water-in fuel or melt-in-fuel type which has as its discontinuous phase an oxidizing salt-containing component and as its continuous phase a fuel component immiscible with the discontinuous phase, the method comprising adding to the emulsion, or replacing at least part of the fuel component in the emulsion with, an aqueous dispersion of a polymer.

* * * * *